US005908322A

United States Patent [19]

Seki

[11] Patent Number: 5,908,322

[45] Date of Patent: Jun. 1, 1999

[54] JOINT CONNECTOR

[75] Inventor: Yoshinobu Seki, Shizuoka, Japan

[73] Assignee: Yazaki Corporation, Tokyo, Japan

[21] Appl. No.: 08/879,968

[22] Filed: Jun. 20, 1997

[30] Foreign Application Priority Data

Jun. 24, 1996 [JP] Japan ..... 8-163438

[51] Int. Cl.[6] ..... H01R 4/60

[52] U.S. Cl. ..... 439/212; 439/949

[58] Field of Search ..... 439/76.2, 212, 439/723, 949; 74/99 B, 72 B, 72 R, 70 B

[56] References Cited

U.S. PATENT DOCUMENTS

| | | | |
|---|---|---|---|
| 4,830,621 | 5/1989 | Maue et al. | 439/723 |
| 5,011,417 | 4/1991 | Matsumoto et al. | 439/76.2 |
| 5,160,274 | 11/1992 | Ozaki et al. | 439/212 |
| 5,618,186 | 4/1997 | Saka et al. | 439/76.2 |

FOREIGN PATENT DOCUMENTS

| | | |
|---|---|---|
| 2-87919 | 3/1990 | Japan . |
| 4-61416 | 5/1992 | Japan . |
| 4-131117 | 12/1992 | Japan . |
| 7-184311 | 7/1995 | Japan . |
| 7-263096 | 10/1995 | Japan . |

*Primary Examiner*—Neil Abrams
*Assistant Examiner*—Barry M.L. Standig
*Attorney, Agent, or Firm*—Morgan, Lewis & Bockius LLP

[57] ABSTRACT

A plurality of bus bars 3 are mounted in a housing 1, and a plurality of reception portions $2A_1$, $2A_2$ and $2A_3$, provided in one side of the housing 1 for receiving a mating connector K, are staggered in a stairs-like manner relative to reception portions $2B_1$, $2B_2$ and $2B_3$ provided in the other side of the housing. With this arrangement, connection pins 5, 5', extending in a branched manner from the bus bars 3, project respectively into the same positions in the associated reception portions 2, and even if the mating connector K is fitted in any of the reception portions 2, metal terminals 6 of the mating connector K are connected respectively to the predetermined connector pins 5, 5'.

10 Claims, 8 Drawing Sheets

JOINT CONNECTOR

BACKGROUND OF THE INVENTION

1. Field of the Invention

This invention relates to a joint connector used mainly for a branch connection of electric wiring in an automobile.

2. Related art

A conventional joint connector J as shown in FIGS. 14 and 16 is disclosed in Japanese Utility Model Unexamined Publication No. 4-131117. In the joint connector J, a plurality of bus bars b, serving as conductor members, are arranged in a juxtaposed manner in a casing a, and connection pins c are connected to each bus bar b, and are exposed to three juxtaposed connection openings d and three juxtaposed connection openings d' which are provided symmetrically in opposite sides of the casing a, respectively.

Since the connection openings d and d' have the same configuration, a mating connector e can be fitted into any of the connection openings d and d'. Therefore, with respect to the connection openings d in one side and the connection openings d' in the other side, the mating connector e can be fitted in any of the connection openings d and d' so as to form the same circuit.

However, in the above joint connector J, a retaining portion f (which retains the mating connector e) in the connection opening d in the one side are provided in opposed relation to a retaining portion f in the connection opening d' in the other side. Therefore, if the mating connector e to be fitted in the connection opening d in the one side is erroneously fitted in the connection opening d' in the other side, metal terminals of the mating connector e to be connected to the bus bar $b_1$ in the connection opening d are connected to the bus bar $b_{11}$ in the connection opening d' remote from the bus bar $b_1$, so that a trouble due to a malfunction of the circuit may occur. Therefore, in order to prevent such erroneous fitting, the operator is required to pay a meticulous attention, and this results in problems that the production efficiency in an assembling process is lowered and that some means for preventing such erroneous fitting must be provided.

SUMMARY OF THE INVENTION

The present invention has been made in view of the above problems, and an object of the invention is to provide a joint connector in which a mating connector of the same configuration can be fitted in any of juxtaposed reception portions provided on opposite sides of a housing, and there is no need for any attention and any means for preventing the erroneous fitting, and a production efficiency and reliability in an assembling process are enhanced.

The above object has been achieved by a joint connector of the present invention wherein a plurality of circuit conductors are mounted in a housing, and a plurality of reception portions for receiving a mating connector are formed in a juxtaposed manner in each of opposite sides of the housing, and are directed outwardly, and connection pins for connection to metal terminals of the mating connector extend from the circuit conductors, and project into the reception portions, wherein the plurality of reception portions have the same configuration; and the connection pins, extending in a branched manner from a base portion of the circuit conductor, project respectively into the same positions in the associated reception portions.

Preferably, retaining portions for the mating connector are formed respectively at the same positions on walls of the reception portions.

Preferably, the circuit conductor is a bus bar which has the connection pins formed respectively on distal ends of a plurality of branch portions extending linearly from opposite sides of a strip-like base portion in opposite directions, and the positions of the reception portions relative to the housing are determined in accordance with the positions of the connection pins.

Preferably, the reception portions are provided on the opposite sides of the housing in opposed relation, and the circuit conductor is a bus bar which has a plurality of branch portions extending from opposite sides of a strip-like base portion to be disposed respectively at the same positions in the reception portions, and the connection pins are formed respectively at distal ends of the branch portions.

According to the present invention, there is provided a joint connector wherein a plurality of circuit conductors are mounted in a juxtaposed manner in a housing, and a plurality of reception portions for receiving a mating connector are formed in a juxtaposed manner in each of opposite sides of the housing, and are directed outwardly, and connection pins for connection to metal terminals of the mating connector extend from the circuit conductors, and project into the reception portions, wherein the connection pins of the circuit conductors in each of the reception portions are arranged on a straight line extending perpendicularly to a direction of arrangement of the reception portions, and are disposed respectively at the same positions; and the reception portion is symmetrical with respect to the straight line.

Preferably, a retaining portion for engagement with a retaining arm of the mating connector is formed on a wall of each of the reception portions disposed on a straight line along which the connection pins in the reception portion are arranged.

DETAILED DESCRIPTION OF THE PREFERRED EMBODIMENTS

A preferred embodiment of the present invention will now be described.

Figure 1:
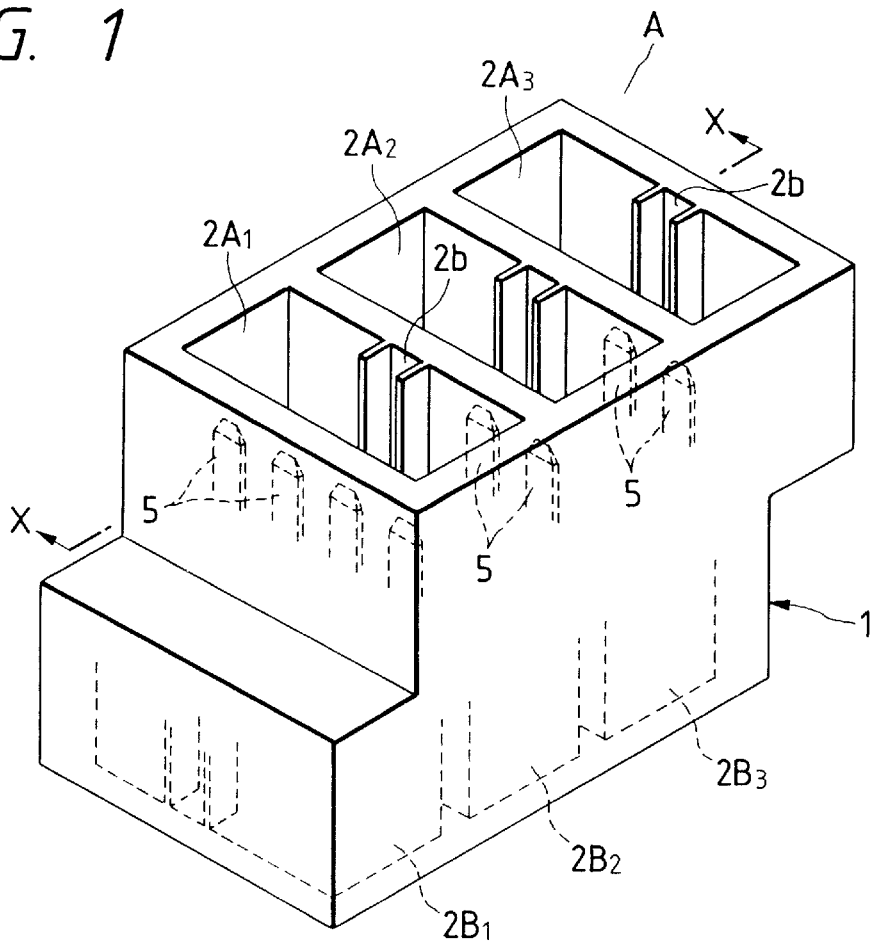
FIG. 1 is a perspective view showing a preferred embodiment of a joint connector A of the present invention.
Figure 2:
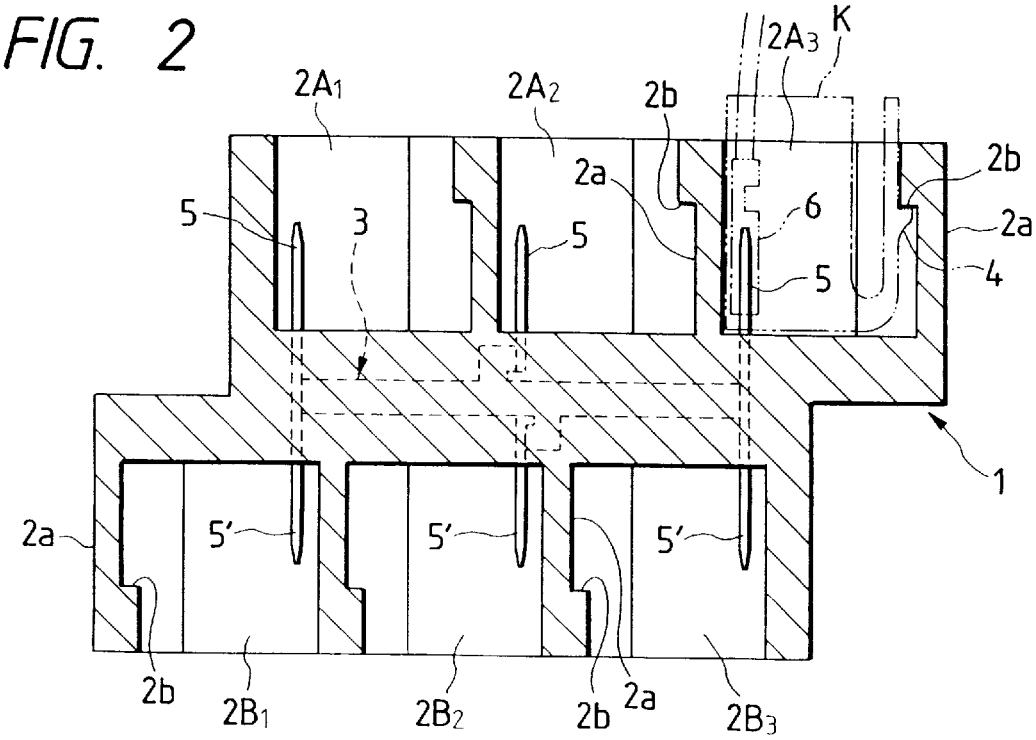
FIG. 2 is a cross-sectional view taken along the line X—X of FIG. 1.

FIG. 1 is a perspective view showing a preferred embodiment of a joint connector A of the present invention, and FIG. 2 is a cross-sectional view taken along the line X—X of FIG. 1.

The joint connector A is molded of a synthetic resin, and has an integral construction. Three reception portions $2A_1$, $2A_2$ and $2A_3$ for receiving a mating connector K are provided in a juxtaposed manner in one side of a housing 1, whereas three reception portions $2B_1$, $2B_2$ and $2B_3$, identical in configuration to the above reception portions, are provided in a juxtaposed manner in the other side of the housing 1. A plurality of bus bars 3, serving as circuit conductors, are provided in a juxtaposed manner in the housing 1.

The reception portions $2A_1$, $2A_2$ and $2A_3$ and the reception portions $2B_1$, $2B_2$ and $2B_3$ (hereinafter often referred to as "reception portions B") have the same configuration and the same construction, and the reception portions $2A_1$, $2A_2$ and $2A_3$ are staggered in a stairs-like manner relative to the reception portions $2B_1$, $2B_2$ and $2B_3$.

Each of the reception portions 2 has an outwardly-open, rectangular box-shape, and a retaining portion 2*b* for engagement with a retaining arm 4 of the mating connector K to retain the same is formed on an inner surface of one side wall 2*a*. The retaining portions 2*b* are formed respectively at the same portions of the side walls 2*a*.

Figure 3:
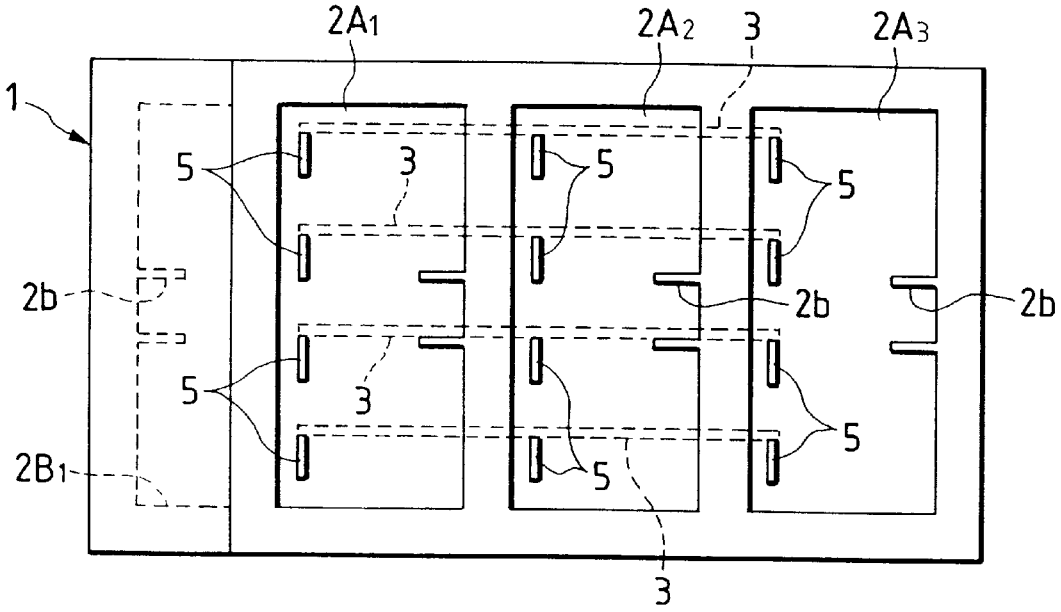
FIG. 3 is a plan view of the joint connector of FIG. 1.

As shown in FIG. 3, four bus bars 3 (serving as the circuit conductors) each formed by blanking a thin metal sheet are mounted within the housing 1 in parallel relation to one another.

Figure 4:
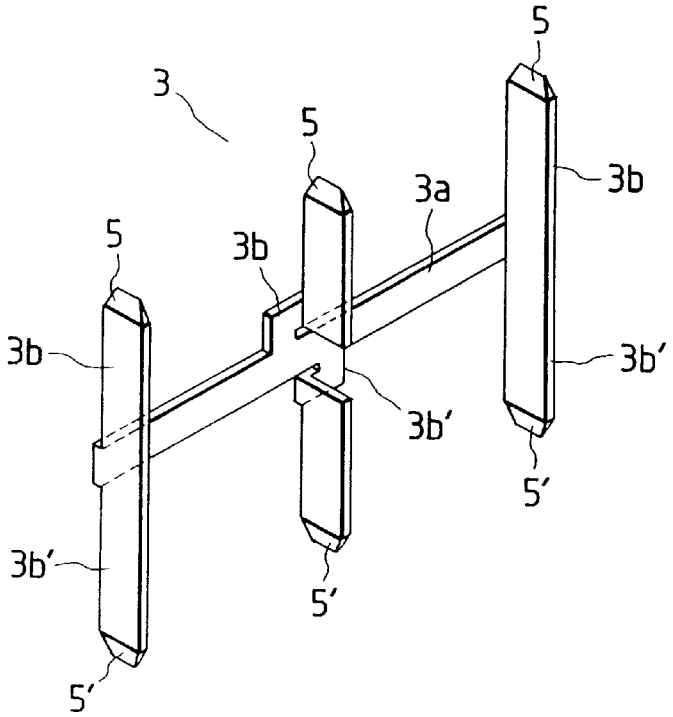
FIG. 4 is a perspective view of a bus bar mounted in a housing in FIG. 1.

As shown in FIG. 4, the bus bar 3 includes a base portion 3*a*, three branch portions 3*b* (corresponding to the reception portions $2A_1$, $2A_2$ and $2A_3$) extending upwardly from one side edge of the base portion 3*a*, and three branch portions 3*b'* (corresponding to the reception portions $2B_1$, $2B_2$ and $2B_3$) extending downwardly from the other side edge of the base portion 3*a*. A connection pin 5 is formed at a distal end of each of the branch portions 3*b*, and similarly a connection pin 5' is formed at a distal end of each of the branch portion 3*b'*.

The connection pins 5 and 5' are disposed generally perpendicularly to the base portion 3*a* of the bus bar 3, and the mating connection pins 5 and 5' are disposed on a common straight line.

Each of the bus bars 3 is mounted in the housing 1 in such a manner that the connection pins 5 and 5' project respectively into the same positions in the associated reception portions 2, and the connection pins 5, 5' can be fitted respectively in four female metal terminals 6 (only one of which is shown) of the mating connector K.

The reception portions $2A_1$, $2A_2$ and $2A_3$ are staggered in a stairs-like manner relative to the reception portions $2B_1$, $2B_2$ and $2B_3$, and with this arrangement the connection pins 5 and 5', disposed on a common straight line, can project respectively into the same positions in the associated reception portions 2. The retaining portions 2*b* for engagement with the mating connector K are formed respectively at the same positions on the side walls 2*a* of the reception portions 2. Namely, when viewed from the side, it appears that the arrangement of the retaining portions 2*b* of the reception portions $2A_1$ to $2A_3$ is reverse relative to the arrangement of the retaining portions 2*b* of the reception portions $2B_1$, to $2B_3$; however, when viewed from the openings of the reception portions 2, the former arrangement is the same as the latter arrangement.

Figure 5:
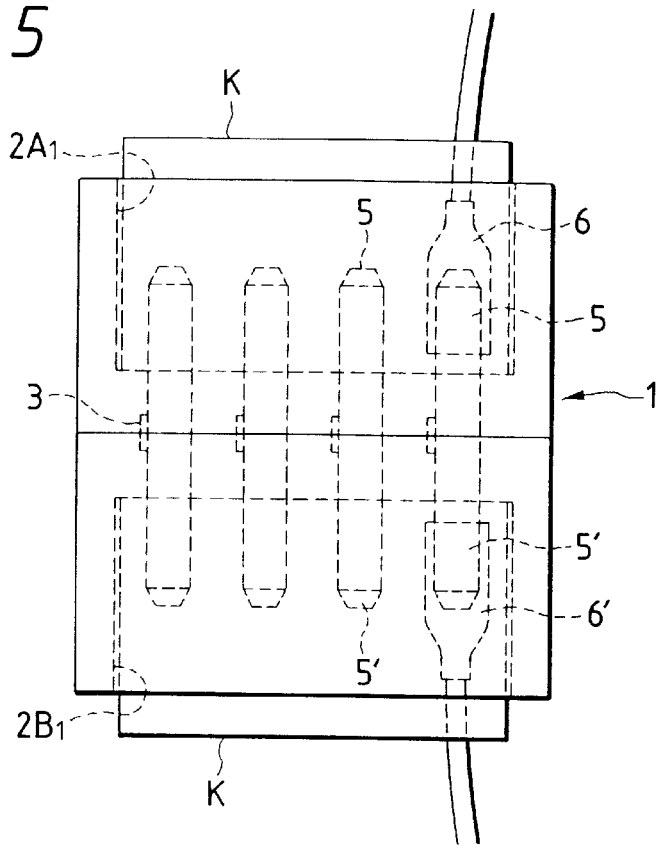
FIG. 5 is a side-elevational view showing a condition in which a mating connector is fitted in the joint connector of FIG. 1.

Therefore, as shown in FIG. 5, even if the mating connector K is fitted in any of the reception portions $2A_1$ to $2A_3$ at one side of the housing or any of the reception portions $2B_1$ to $2B_3$ at the other side, the connection pins 5 or 5' are connected respectively to the female metal terminals 6 of the mating connector K, and therefore the circuit can be connected through the same bus bars 3. And besides, the retaining portions 2*b* are provided respectively at the same positions on the side walls 2*a* of the reception portions 2, and therefore even if the mating connector K is fitted in any of the reception portions $2A_1$ to $2A_3$ at one side of the housing or any of the reception portions $2B_1$ to $2B_3$ at the other side, the retaining arm 4 of the mating connector K can be retainingly engaged with the retaining portion 2*b*. Therefore, the mating connector K can be properly fitted in any of the reception portions $2A_1$, $2A_2$ and $2A_3$ and the reception portions $2B_1$, $2B_2$ and $2B_3$ at the opposite sides of the housing 1.

Figure 6:
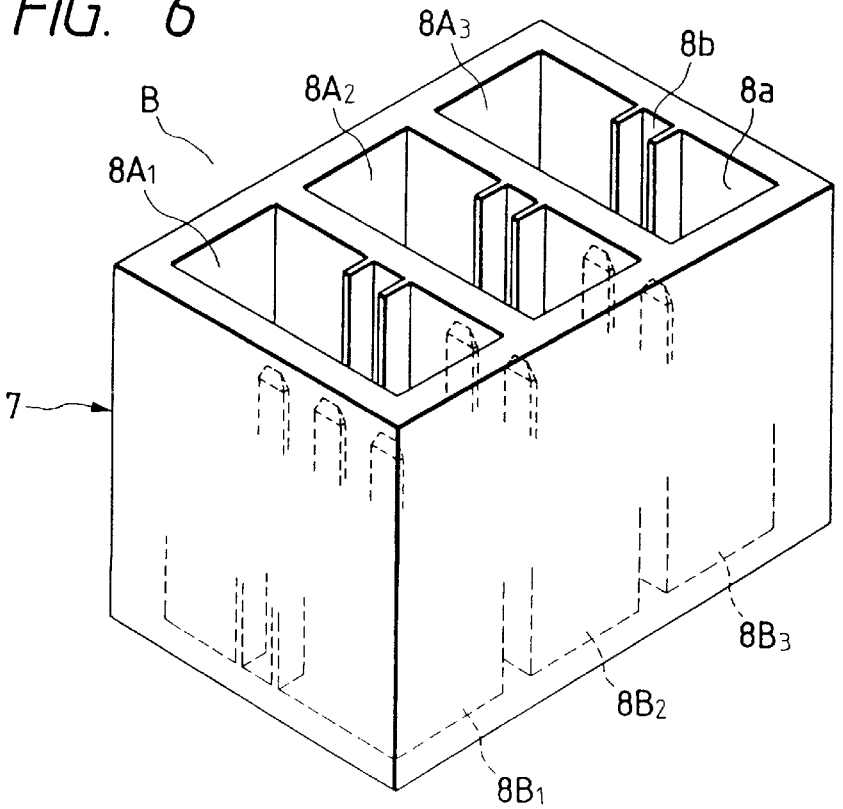
FIG. 6 is a perspective view showing another embodiment of a joint connector of the present invention.
Figure 7:
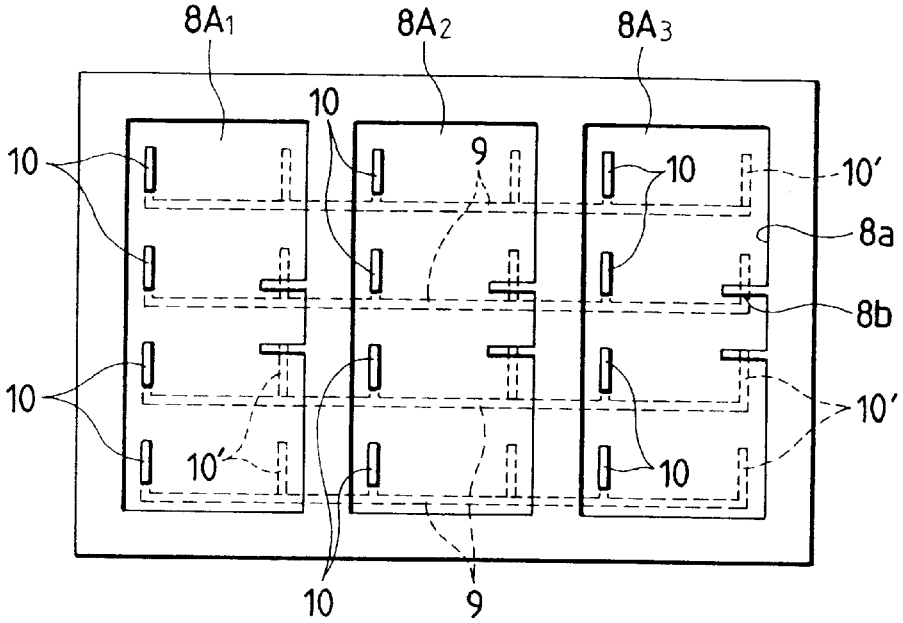
FIG. 7 is a plan view of the joint connector of FIG. 6.
Figure 8:
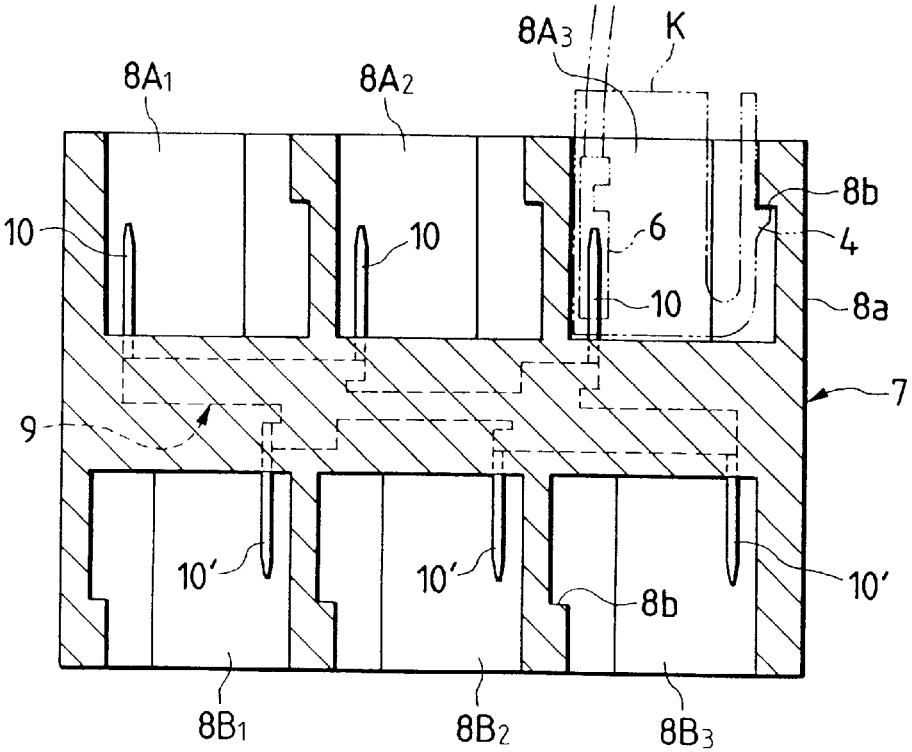
FIG. 8 is a vertical cross-sectional view of the joint connector of FIG. 6.

FIG. 6 is a perspective view showing another embodiment of a joint connector B of the present invention, and FIG. 7 is a plan view thereof.

In the joint connector B, three reception portions $8A_1$, $8A_2$ and $8A_3$ for receiving a mating connector K are provided in a juxtaposed manner in one side of a housing 7, whereas three reception portions $8B_1$, $8B_2$ and $8B_3$, identical in configuration to the above reception portions, are provided in a juxtaposed manner in the other side of the housing 7. A plurality of (four in FIG. 7) bus bars 9, serving as circuit conductors, are provided in a juxtaposed manner in the housing 7.

The reception portions $8A_1$, $8A_2$ and $8A_3$ and the reception portions $8B_1$, $8B_2$ and $8B_3$ have the same configuration and the same construction as those of the reception portions 2 of the above joint connector A, and this joint connector differs from the joint connector A in that the reception portions $8A_1$, $8A_2$ and $8A_3$ are not staggered in a stairs-like manner relative to the reception portions $8B_1$, $8B_2$ and $8B_3$, so that the housing 7 has a rectangular parallelepiped shape as a whole.

Figure 9:
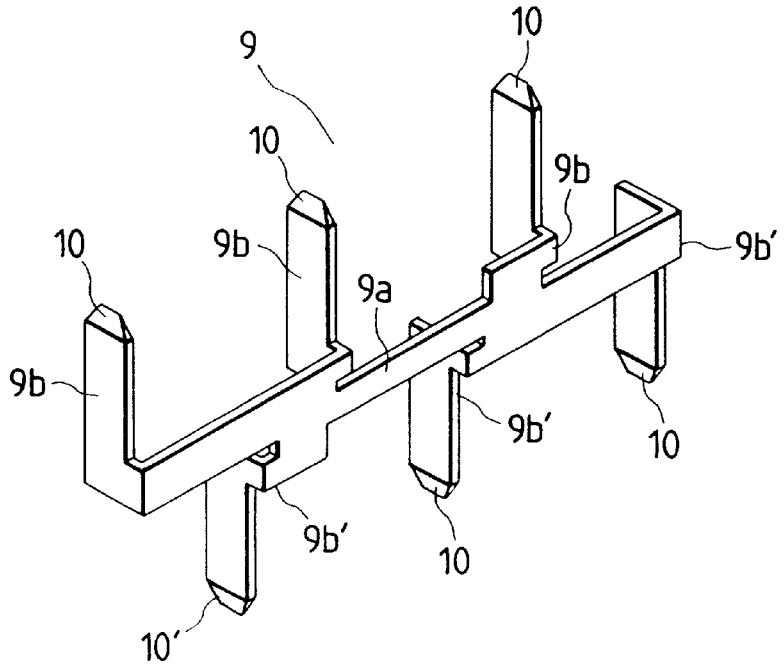
FIG. 9 is a perspective view of a bus bar mounted in a housing in FIG. 6.

Therefore, each of the bus bars 9, mounted in the housing 7, is formed into a construction shown in FIG. 9, and with respect to any of the reception portions $8A_1$, $8A_2$ and $8A_3$, $8B_1$, $8B_2$ and $8B_3$ (hereinafter often designated at 8), connection pins 10 of the bus bar 9 project respectively into the same positions in the associated reception portions 8.

As in the above joint connector A, each of the reception portions 8 has an outwardly-open, rectangular box-shape, and a retaining portion 8*b* for engagement with a retaining arm 4 of the mating connector K to retain the same is formed on one side wall 8*a*.

In the bus bar 9, branch portions 9*b* and 9*b'*, extending from a base portion 9*a*, are so bent as to be disposed respectively at the same (or corresponding) positions in the reception portions 8, and a connection pin 10 is formed at a distal end of each of the branch portions 9*b*, and similarly a connection pin 10' is formed at a distal end of each of the branch portions 9*b'*. Therefore, there is achieved an advantage that the housing 7 can be formed into a rectangular parallelepiped shape, and hence can be formed into a compact design.

Figure 10:
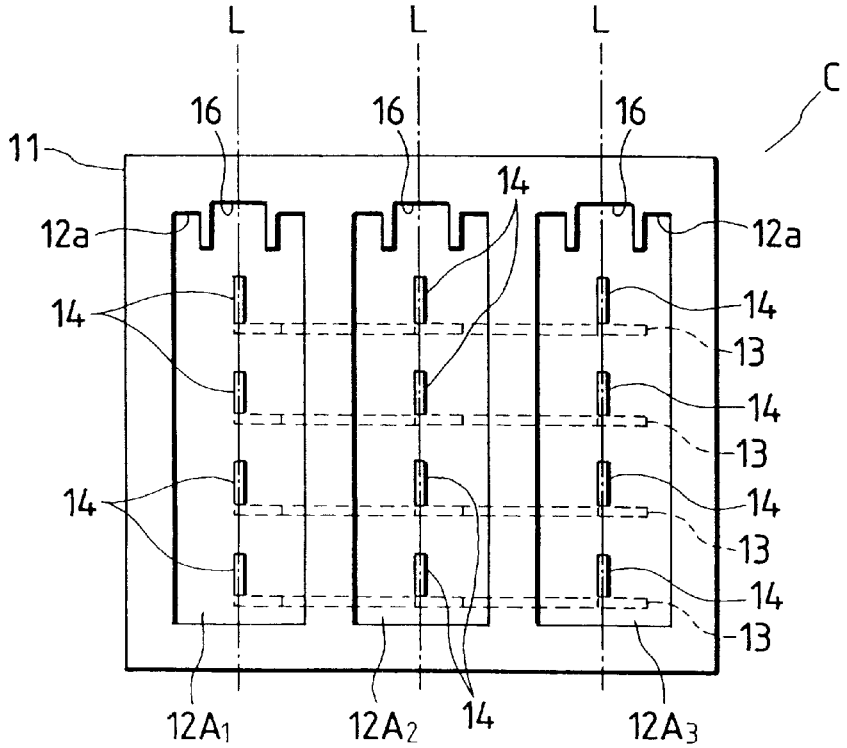
FIG. 10 is a plan view of a further embodiment of a joint connector of the present invention.
Figure 11:
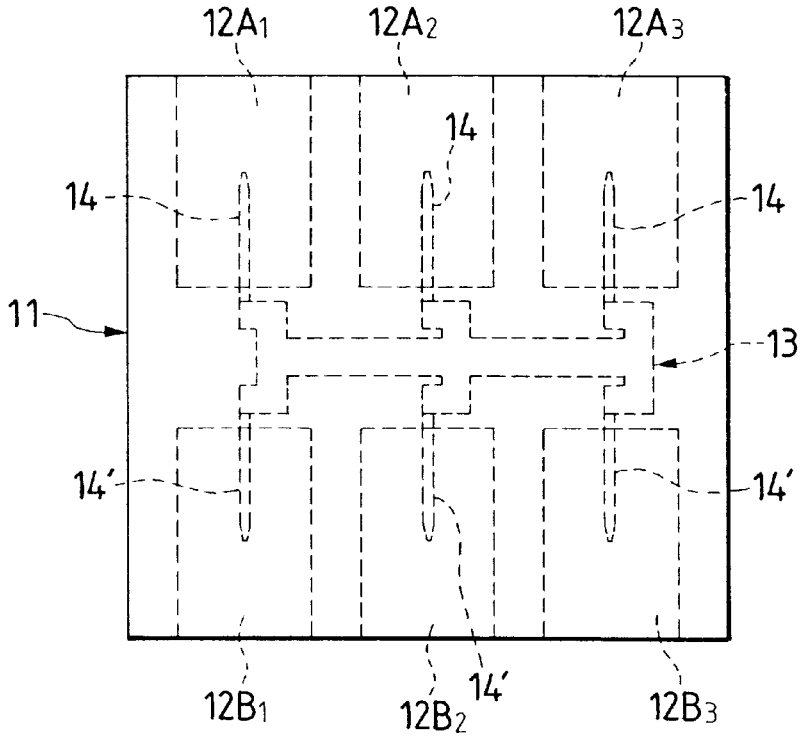
FIG. 11 is a front-elevational view of the joint connector of FIG. 10.

FIG. 10 is a plan view of a further embodiment of a joint connector C of the present invention, and FIG. 11 is a front-elevational view thereof.

In the joint connector C, three reception portions 12$A_1$, 12$A_2$ and 12$A_3$ are provided in a juxtaposed manner in one side of a housing 11, whereas three reception portions 12$B_1$, 12$B_2$ and 12$B_3$, identical in configuration to the above reception portions, are provided in a juxtaposed manner in the other side of the housing 11, the reception portions 12$A_1$, 12$A_2$ and 12$A_3$ and the reception portions 12$B_1$, 12$B_2$ and 12$B_3$ being disposed symmetrically (These reception portions will be often designated at 12). Four bus bars 13 are provided in a juxtaposed manner in the housing 11, and in each of the reception portion 12, connection pins 14, extending respectively from the bus bars 13, are arranged on a straight line in a projected manner. The connection pins 14 in each reception portion 12 are arranged on a straight line L extending perpendicularly to the direction of arrangement of the reception portions 12.

Figure 12:
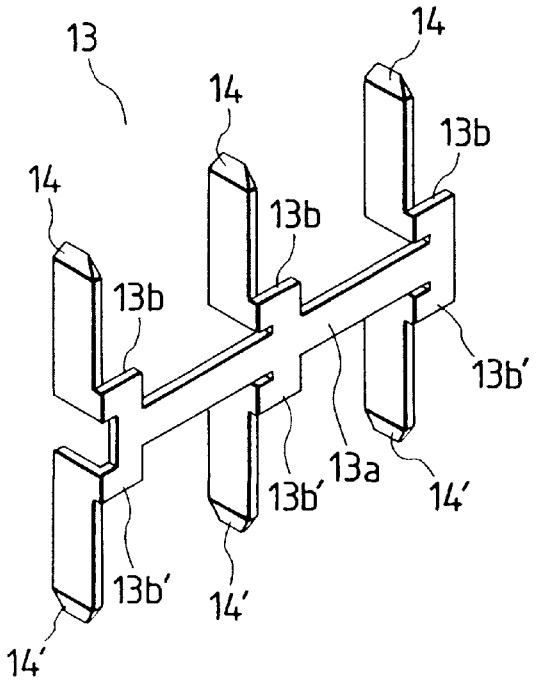
FIG. 12 is a perspective view of a bus bar mounted in a housing in FIG. 10.

As shown in FIG. 12, in the bus bar 13, branch portions 13*b* extend upwardly from one side edge of a base portion 13*a*, and branch portions 13*b'* extend downwardly from the other side edge of the base portion 13*a*, the branch portions 13*b* and the branch portions 13*b'* being symmetrical with respect to the base portion 13*a*. The connection pin 14 is formed on each of the branch portions 13*b* whereas a connection pin 14' is formed on each of the branch portions 13*b'*, each of the connection pins 14 and 14' being disposed on a centerline of the associated reception portion 12.

Each of the reception portion 12 has a rectangular shape, and is symmetrical with respect to the straight line L, and in each of the reception portions 12, a retaining portion 16 for engagement with a retaining arm 15 of a mating connector K is formed on an inner surface 12*a* of one side wall of the housing 11, and is disposed on the straight line L.

Figure 13:
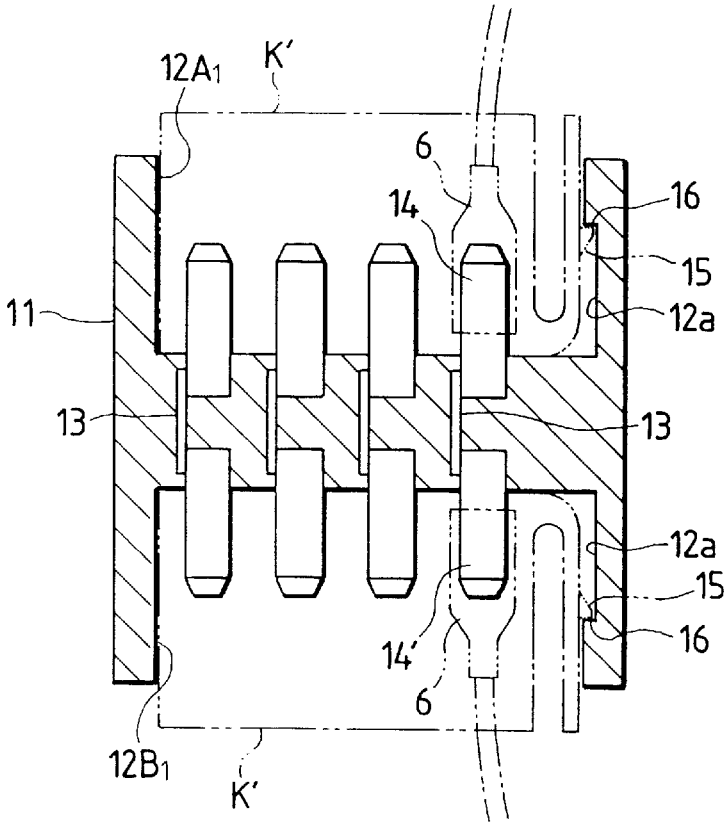
FIG. 13 is a cross-sectional view showing a condition in which a mating connector is fitted in the joint connector of FIG. 10.
Figure 14:
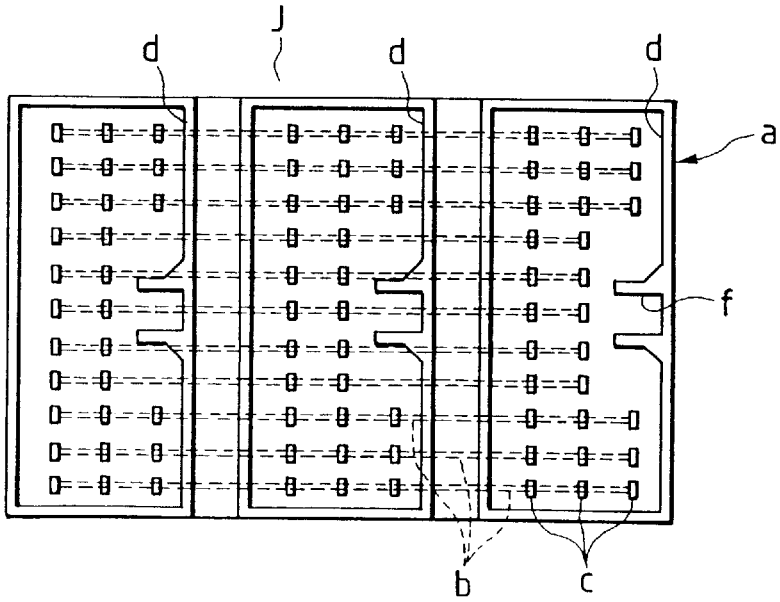
FIG. 14 is a plan view showing a conventional joint connector.
Figure 15:
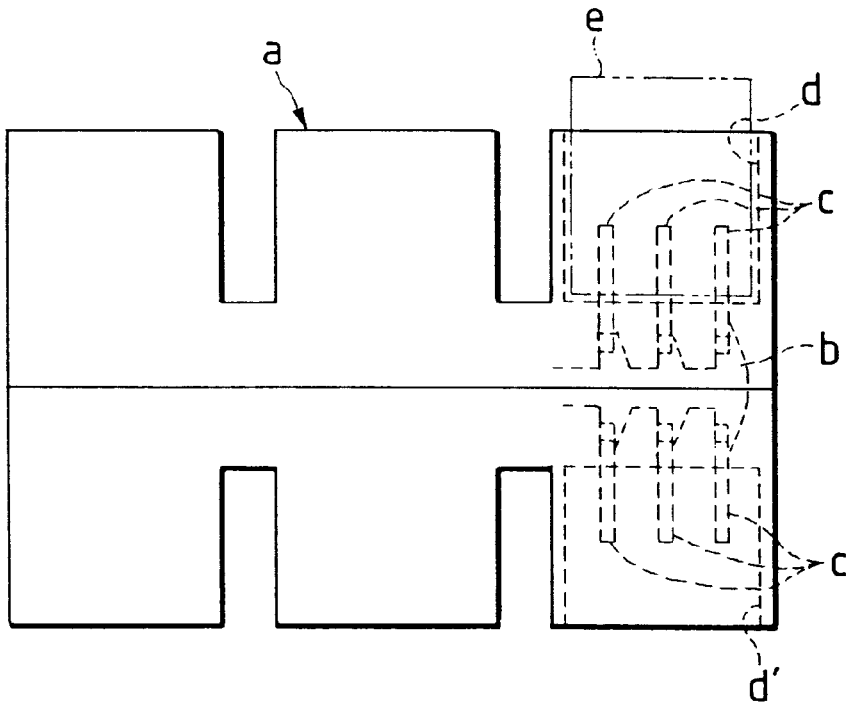
FIG. 15 is a front-elevational view of the joint connector of FIG. 14.
Figure 16:
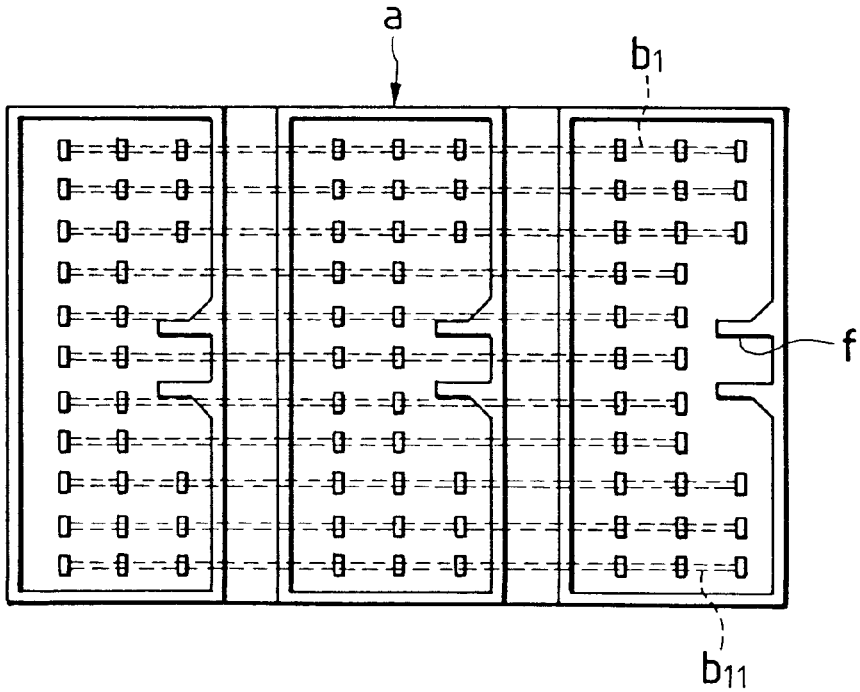
FIG. 16 is a view explanatory of the position of a bus bar to be connected when a mating connector is fitted in the joint connector of FIG. 14.

Female metal terminals 6 are provided in the mating connector K', and are arranged on a straight line, and the mating connector K' is symmetrical with respect to the arrangement of the metal terminals 6, and each reception portion 12 of the joint connector C for receiving the mating connector K' is also symmetrical with respect to the arrangement of the connection pins 14. Therefore, as shown in FIG. 13, even if the mating connector K' is fitted in any of the reception portions 12 in the opposite sides of the housing 11, the same connected circuit is obtained, and therefore any attention for preventing the erroneous fitting during the assembling operation is not needed.

In the present invention, the positions of the reception portions (which receive the mating connector) provided in the opposite sides of the housing, as well as the configuration of the circuit conductors mounted in the housing, are so determined that the connection pins project respectively into the same positions in the associated reception portions, and therefore even if the mating connector is fitted in any of the reception portions of the housing, the same circuit is obtained, and therefore any erroneous fitting during the assembling operation is eliminated, and any attention is needed for preventing the erroneous fitting.

In the present invention, the connection pins in each of the reception portions are arranged on a straight line, and the reception portion is symmetrical with respect to this straight line. Therefore, even if the mating connector is fitted in any of the reception portions of the housing, and any erroneous fitting is eliminated, and the production efficiency and reliability in the assembling process are greatly enhanced.

What is claimed is:

1. A joint connector for connecting a plurality of mating connectors in a branch connection, comprising:

a housing having first and second sides on opposite sides of the housing;

a circuit conductor mounted in the housing;

a first plurality of reception portions directed outwardly from the first side of the housing;

a second plurality of reception portions directed outwardly from the second side of the housing, the first and second reception portions being staggered on opposite sides of the housing, each one of the first and second reception portions having substantially the same configuration;

a plurality of connection pins extending from the circuit conductor and projecting into respective ones of the first and second reception portions, the connection pins having substantially corresponding positions within the respective ones of the first and second reception portions; and a plurality of retaining projections extending from side walls of respective ones of the first and second reception portions for retaining the respective mating connectors, the retaining projections having substantially corresponding positions within the respective ones of the first and second reception portions.

2. The joint connector according to claim 1, wherein each one of the first and second reception portions receive a respective mating connector.

3. The joint connector according to claim 1, wherein each one of the connection pins connects to a metal terminal of a respective mating connector.

4. The joint connector according to claim 1, wherein corresponding ones of the connector pins are co-axial.

5. The joint connector according to claim 2, wherein the retaining projections engage a retaining arm of a respective mating connector.

6. The joint connector according to claim 1, wherein the circuit conductor includes a bus bar having a strip-like base portion and a plurality of branch portions extending linearly from opposite sides of the strip-like base portion in opposite directions, wherein the connection pins are disposed at distal ends of the branch portions.

7. The joint connector according to claim 1, wherein the circuit conductor includes a bus bar having a plurality of branch portions extending from opposite sides of a strip-like base portion, wherein the branch portions are respectively disposed at corresponding positions in respective ones of the first and second reception portions, and wherein the connection pins are respectively disposed at distal ends of the branch portions.

8. A joint connector for connecting a plurality of mating connectors in a branch connection, comprising:

a housing having first and second sides on opposite sides of the housing;

a circuit conductor mounted in the housing;

a first plurality of reception portions directed outwardly from the first side of the housing;

a second plurality of reception portions directed outwardly from the second side of the housing, the first and second reception portions being aligned on opposite sides of the housing, each one of the first and second reception portions having substantially the same configuration;

a plurality of connection pins extending from the circuit conductor and projecting into respective ones of the first and second reception portions, the connection pins having substantially corresponding positions within the respective ones of the first and second reception portions; and a plurality of retaining projections extending from side walls of respective ones of the first and second reception portions for retaining the respective mating connectors, the retaining projections having substantially corresponding positions within the respective ones of the first and second reception portions.

9. The joint connector according to claim 8, wherein the retaining projections engage a retaining arm of a respective mating connector.

10. The joint connector according to claim 8, wherein corresponding ones of the connector pins are co-axial.

* * * * *